US005980055A

United States Patent [19]

Palmer et al.

[11] Patent Number: 5,980,055

[45] Date of Patent: Nov. 9, 1999

[54] CHEMILUMINESCENT DEVICES HAVING INTEGRAL LIGHT SHIELDS

[75] Inventors: William R. Palmer; Stephen L. Palmer, both of Cameron Park, Calif.

[73] Assignee: Omniglow Corporation, West Springfield, Mass.

[21] Appl. No.: 08/940,689

[22] Filed: Sep. 30, 1997

[51] Int. Cl.[6] ..... F21K 2/00

[52] U.S. Cl. ..... 362/34; 206/219

[58] Field of Search ..... 362/34, 806, 351; 206/219; 252/700

[56] References Cited

U.S. PATENT DOCUMENTS 4,193,109 3/1980 Heffernan et al. ..... 362/34

4,814,949 3/1989 Ellitt .

5,226,710 7/1993 Giglia et al. ..... 362/34

*Primary Examiner*—Nimeshkumar D. Patel

*Assistant Examiner*—Michael J. Smith

*Attorney, Agent, or Firm*—McHale & Slavin PA

[57] ABSTRACT

The instant invention is a light shield formed integral with chemiluminescent devices to effectively block ambient light thereby inhibiting photo degradation of chemical reagents when exposed to external light sources. The light shield displaces conventional foil or the like product packaging designed to protect against light yet permits instant and easy activation of chemiluminescent reagents without interfering with the chemiluminescent reaction. The integral light shields further simplify packaging and extend the product shelf life of the chemiluminescent reagents.

26 Claims, 5 Drawing Sheets

CHEMILUMINESCENT DEVICES HAVING INTEGRAL LIGHT SHIELDS

FIELD OF THE INVENTION

This invention is directed to the field of chemiluminescent devices and in particular to chemiluminescent devices having light shields formed integral thereto for extending the shelf life of the chemiluminescent reagents.

BACKGROUND OF THE INVENTION

Chemiluminescent devices are non-incandescent products which produce light from a mixture of chemicals. These devices are most valuable for emergency lighting applications such as when normal electrical power service is interrupted. Power interruptions often accompany storms, floods, hurricanes, fires, earthquakes and the like natural disasters. Additionally, because chemiluminescent devices do not rely on electricity for operation, they are readily and reliably used in wet environments, even under water, where electrically powered devices could short out and fail.

Also unique to chemiluminescent devices are their ability to produce light without generating heat. Since chemiluminescent devices are not electrically operated or sources of ignition, they are ideally suited to emergency situations such as the aforementioned disasters. For instance, in situations where flammable vapors such as gasoline or natural gas may be present, conventional illumination such as candles, lanterns or even flashlights pose extreme danger as potential sources of ignition.

The production of light from a chemiluminescent device is conventionally based upon the reaction of a catalyzed hydrogen peroxide mixture (activator) with an oxalate. Chemiluminescent devices are also commercially available in a variety of visible colors as well as non-visible infrared which may be viewed through the use of special optical systems. A great variety of chemical reagents for producing light by chemiluminescent reaction are known. A typical commercially available chemiluminescent device that produces a yellow color can be created from the following constituents: Dibutyl Phthalate 66.45%; Dimethyl Phthalate 20–35%; CPPO bis(2,4,5-trichloro-6-carbopentoxyphenyl) oxalate 8.33%; T-butyl alcohol 3.3%; 90% aq. Hydrogen Peroxide 1.32%; CBPEA 1-chloro-9,10-bis(phenylethynyl) anthracene 0.23%; and Sodium Salicylate 0.0025%. One example of such a chemiluminescent device is taught in U.S. Pat. No. 5,043,851.

The activator reagent is typically contained within a breakable vial (s) which, when broken, admixes with the oxalate reagent to produce the chemiluminescent light. The activator and oxalate placement may be reversed. Since the object of this type of device is to produce usable light output, the containment vessel is made of a clear or translucent material such as polyethylene or polypropylene which permits the light produced by the chemiluminescent device to pass through the vessel walls.

Numerous packaging schemes for chemiluminescent devices are also well known whereby the chemical mixtures are kept separate until such time as light production is desired. U.S. Pat. No. 4,814,949 discloses a separation scheme whereby both chemical solutions are sealed in frangible vials which are housed together in a larger, flexible vessel. U.S. Pat. No. 4,379,320 discloses a co-axial vial system. U.S. Pat. No. 5,067,051 discloses a structure that maintains chemical separation by use of a disk which is situated diametrically within a plastic tube, thereby forming a barrier between the chemicals positioned on either side of the disk. When activation is desired, externally applied forces cause the disk to flip more or less 90 degrees thereby permitting mixing of the chemicals. U.S. Pat. No. 5,552,968 discloses a sphere or ball for separation of oxalate and activator component. The oxalate component in the above device may contain Dibutyl Phthalate, CPPO and CBPEA while the activator may contain the Dimethyl Phthalate, T-butyl alcohol, 90 aq. Hydrogen Peroxide, and Sodium Salicylate.

Both the oxalate and activator reagents described in the above chemiluminescent devices are prone to photo chemical degradation. That is, the chemical components undergo changes and break down upon exposure to light. While high energy, ultraviolet radiation is potentially the most damaging light to these chemical systems, even visible light causes product degradation. If these degradation processes are unchecked, the chemical solutions will eventually be degraded to such point whereby the device will fail to function. Many fluorescers such as CBPEA used in many chemiluminescent devices are severely degraded after just one day's exposure to sunlight. Additionally, hydrogen peroxide will degrade upon exposure to light. This combined degradation limits shelf life and product usefulness.

Product packaging is typically how chemiluminescent chemicals are protected from light to promote product shelf life. For example, product packaging for chemiluminescent light sticks have been produced from optically opaque, metallic foil and plastic film laminates to shield the chemiluminescent reagents from photo degradation whether from natural or artificial light. Another method to protect chemiluminescent products from photo degradation is to package the chemiluminescent devices in bulk, either in metal buckets or cardboard tubes. In either event, external product packaging, whether it be a foil wrapper or cardboard tubes, once opened or damaged may allow light to contact the chemical reagents leading to the photo degradation.

Another problem with external product packaging is the need to open the package before usage of the chemiluminescent device. In an emergency situation, should an individual's hand be wet or in a weakened condition, this extra step may render the device unusable. In emergency situations it is impractical to remove a chemiluminescent device from foil wrappers prior to activation. Also, tools may not be readily available to open the buckets or cardboard tubes of bulk packaged products. Additionally, metal films are subject to corrosion when in the prolonged presence of moisture which limits their effective application in this instance. External packaging, if improperly discarded, presents a waste product that is not readily recycled and hence is usually relegated to incineration or a landfill.

U.S. Pat. No. 4,814,949 discloses a chemiluminescent device formed from two polymeric sheets, one of which has a cavity formed into it for receipt of an absorbent article and chemiluminescent reagents. The second polymeric sheet is sealed peripherally to the first sheet to seal in the aforementioned absorbent article and receptacles. Activation may be accomplished through the application of a force on the polymeric sheet which causes the receptacles to rupture and the reagents to mix. While '949 protects chemical reagents from actinic light, the device is simply a heat sealed pouch fabricated from a polyolefin/foil laminate. Metallic foil laminates are expensive and if a pouch is used instead of vials, chemical migration through the heat seal layer is possible. Hydrogen peroxide activators exhibit a propensity for migration through polyolefins and most other polymers. Even small traces of these peroxygens are capable of rendering the oxalate reagent incapable of producing light.

Thus, what is lacking in the art is a chemiluminescent product having a light shield formed integral thereto for the protection of chemical reagents from photo degradation while maintaining a chemiluminescent device having similar properties of light production and easy instant activation when needed.

SUMMARY OF THE INVENTION

The teaching of the instant invention creates a new class of chemiluminescent devices which, because of their highly light resistant design, may be stored or deployed in situations which were heretofore impractical. The chemiluminescent device produced provides a low cost, effective solution to the problem of photo degradation of chemiluminescent reagents.

The instant invention is a light shield formed integral with chemiluminescent devices to effectively block ambient light thereby inhibiting photo degradation of chemical reagents when exposed to external light sources. The light shield displaces conventional foil or the like product packaging designed to protect against light yet provides superior protection of the chemiluminescent reagents. In addition, the light shields permit instant and easy activation of chemiluminescent reagents without interfering with the chemiluminescent reaction.

For instance, a self contained chemiluminescent lighting device employing this technology may be conveniently located on a wall of a building or bulkhead of a vessel. Because said device requires no external protection from ambient light, such a device may be installed months or years prior to-use, even though no additional protection from ambient light is provided. When needed, the device is ready for immediate use and can begin providing useful light within seconds of activation. Activation of this type of device for example, may be accomplished by merely striking the face of the device with one's bare hand.

The application of such a device makes it invaluable for countless situations. For example, after a disaster such as an earthquake, such a device would provide critical support if conveniently located near an office work station such as on the underside of a desk. Likewise, in a residential setting, a device of this type would aid in safe egress from a damaged home even during blackout conditions. Similarly, such devices could easily be employed in aircraft and ships to provide intrinsically safe light sources during an emergency.

Accordingly, it is an object of the instant invention is to teach packaging formed integral with chemiluminescent products which effectively block ambient light to inhibit photo degradation of chemical reagents when exposed to external light sources.

It is yet another object of the instant invention to teach product packaging of light protection devices that permit instant and easy activation of chemiluminescent reagents and are chemically inert so as not to interfere with the chemiluminescent reaction.

Still another object of the instant invention is to provide light resistant chemiluminescent devices which require little or no external packaging to prevent premature degradation of chemical reagents.

Yet still another object of the instant invention is to teach an integral shielding product that allows useful chemiluminescent light to escape from the chemiluminescent device.

Still another object of the instant invention is to teach material compatibility wherein the integral shield provides minimal, if any, interference to the chemiluminescent activation process.

Yet still another object of the instant invention is to eliminate the potential waste caused by external packaging.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DISCLOSURE OF THE PREFERRED EMBODIMENT

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

For an integral light shield to function effectively with chemiluminescent systems four conditions must be satisfied. These conditions are:

1. The light shield must effectively block ambient light from the chemiluminescent reagents.

2. The light shield must be chemically inert so as not to interfere with the chemiluminescent reaction.

3. The light shield must allow the useful chemiluminescent light to escape from the chemiluminescent device.

4. The light shield must present minimal, if any interference to the activation process Various embodiments of internal light shields for chemiluminescent systems are hereinafter disclosed. The word "internal" when used here means that the shield is inside of the most external container or other element in the chemiluminescent device and that no external wrapper or other light protection means is required to protect the chemiluminescent device from ambient light.

Figure 1:
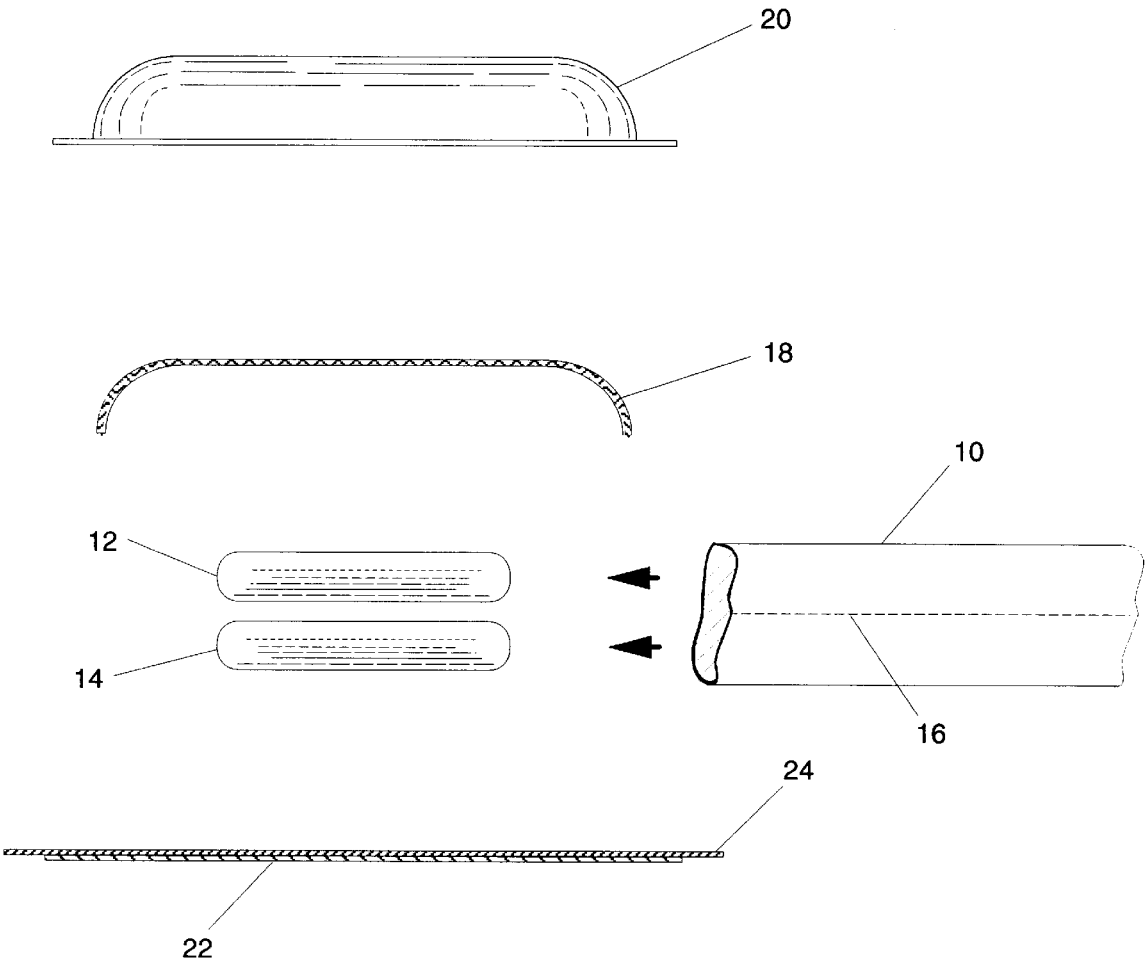
FIG. 1 is an exploded side view of a chemiluminescent device wherein the light shield takes the form of an optically opaque plastic bag which contains the reagent ampoules.

As shown in FIG. 1, an exploded side view of a chemiluminescent device is depicted wherein the light shield takes the form of an optically opaque plastic film 10 which contains the reagent Activator 12 and Oxalate 14 ampoules.

In this embodiment, the bag is formed from a thin, black, polyolefin film to protect the reagents from external light while in a storage position. When this film 10 is partially or completely peripherally sealed to form a bag, this bag may also function as a premix chamber to promote admixing of the chemiluminescent reagents after activation. The bag may be perforated 16 to permit the mixed chemiluminescent solution to leak out of the bag be absorbed into an absorbent material 18. Alternately, the bag may be un-perforated and rely on perforation during activation from the glass shards which are produced when the frangible ampoules 12 and 14 are broken. The black plastic film 10 depicted may have a thickness between 0.00051" and 0.006". Integral light shields fabricated from these materials have been found to be highly effective in preserving and protecting the chemiluminescent reagents from exposure to ambient light even when said ambient light is direct sunlight and exposure duration exceeds several months. Polypropylene, Teflon® or any other polymer material which is functionally opaque and does not interfere with the chemiluminescent process may be used. Carbon black is commonly used as a pigment for coloring polyethylene films. This pigment is blended into the plastic resin before the product is extruded or "blown" into film. Tests designed to compare the effect, if any, on chemiluminescent light production efficiency in the presence of these pigmented films yielded no discernible decrease in chemiluminescent action in systems employing the black, pigmented polyethylene verses the clear, un-pigmented polyethylene. The pigmented plastic did slightly reduce the visible light emitted from the chemiluminescent process, but this light loss was determined to be due to optical absorption of light by the black plastic and not due to interference with the chemiluminescent reaction.

The sealed reagents 12 and 14, placed within the film 10 may then be placed into a container as formed by blister lid 20, preferably constructed from HDPE which is lined with the absorbent material 18 preferably a non-woven felt polyester. The lid 20 is then sealed to a base 24 also constructed from HDPE with a pressure sensitive adhesive with release liner 22. In this embodiment, the assembled unit may be mounted on a wall and during an emergency, the blister lid struck causing activation of the sealed ampoules 12 and 14. Once the reagents are released from the ampoules and admixed, the receptacles will cause perforations through the film 10, with or without the perforation 16. The reagents are admixed and are absorbed into the absorbent material 18 providing an even production of light that is transmitted through the blister lid.

Figure 2:
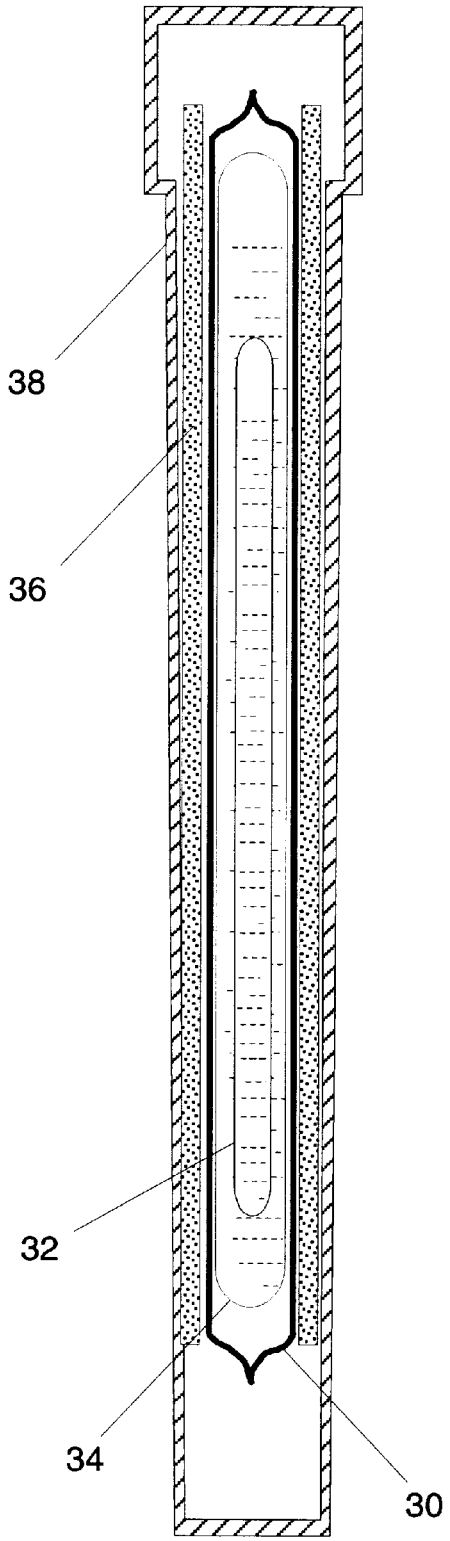
FIG. 2 is a cross sectional side view of a chemiluminescent light stick illustrating an optically opaque sleeve which surrounds the reagent ampoules.

FIG. 2 illustrates a heat shrinkable, opaque plastic tubing 30 for use as a light shield. In this embodiment, both polyethylene and polyvinyl chloride plastic tubing were found to be functional. In assembling, a first glass ampoule 32 containing an activator reagent and a second glass ampoule 34 containing oxalate reagent were positioned inside a length of heat-shrinkable polyethylene tubing 30. The length of polyethylene tubing was somewhat longer than the ampoules 32 and 34 to be protected so that the ends of the ampoules might also be protected as the tube shrank around the ampoule ends. Heat was applied to the tubing 30 whereupon the tubing 30 shrank quickly and tightly around the two ampoules 32 and 34. The ends of the ampoules while being somewhat protected from light by the tubing, were nevertheless still exposed to some level of ambient light. A further step of pressing the plastic tubing 30 ends closed with a crimping device provides light sealing on both ends. A black tubing suitable for use is manufactured by Markel Corporation, Norristown, Pa. and is designated as "Flexite" PO-135-125C. Wall thickness of this tubing before shrinking was 0.017". Oxalate and activator ampoule sets that are prepared with the "Flexite" PO-135-125C, as described above, showed no signs of photo degradation even after exposure to direct sunlight for periods exceeding 90 days.

The tubing may also be a heat shrinkable polyvinyl chloride tubing which can be substituted for the polyethylene tubing. The polyvinyl chloride tubing also shrank tightly around the ampoules upon application of heat. The polyvinyl chloride tubing is more flexible and has a higher shrink ratio as compared to the polyethylene tubing. It therefore tended to form around the ends of the ampoules more readily than did the polyethylene tubing and the crimping process previously employed was deemed unnecessary to close the ends of the tubing. The polyvinyl chloride tubing also proved to be an effective, long term, light shield. It is noted however, that polyvinyl chloride tubing interferes slightly with the chemiluminescent process, thereby marginally diminishing the effective light output of the chemiluminescent system yet still produces highly useful light. The black polyvinyl chloride tubing used to perform these tests was supplied by Seal-It, Inc. Hicksville, N.Y. and had a wall thickness of 0.002" before shrinking.

The ampoule 32 and 34, shown sealed within the tubing 30 are then surrounded by an absorbent medium 36. The casing 38 is transparent allowing an even distribution of light produced from the admixed reagents once absorbed into the absorbent medium 36.

Figure 3:
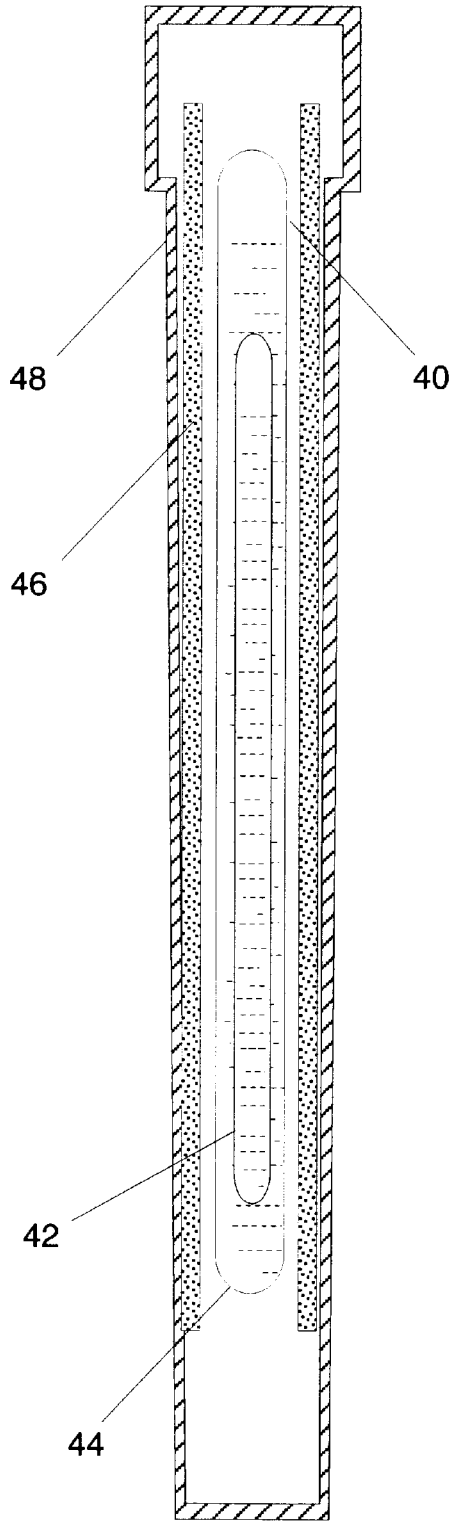
FIG. 3 is a cross sectional side view of a chemiluminescent light stick illustrating an optically opaque coating which is applied to the external surface of the outermost reagent ampoule.

FIG. 3 illustrates the use of an optically opaque, organic coating 40 which is applied to the outer surface of the ampoules 42 and 44. If coaxial ampoules are used it is necessary only to apply the coating to the outermost ampoule as illustrated. A highly opaque, black paint was applied by spraying to the outer ampoule of a coaxial system. One such paint used for this process is "Rust-Oleum"® #7779, gloss black. The paint is permitted to dry for 24 hours at approximately 72° F. and examined for scratches, pinholes and voids by utilizing an ultraviolet viewing box. The oxalate solution contained in the coated ampoule fluoresces brightly when illuminated by ultraviolet light. Any sign of fluorescence from the ampoule would indicate that the paint had not completely coated the surface of the ampoule.

The ampoule 42 is shown sealed within ampoule 44, which is then coated with the paint 40. The ampoule is then surrounded by an absorbent medium 46. The casing 48 is transparent allowing an even distribution of light produced from the admixed reagents once absorbed into the absorbent medium 46.

Figure 4:
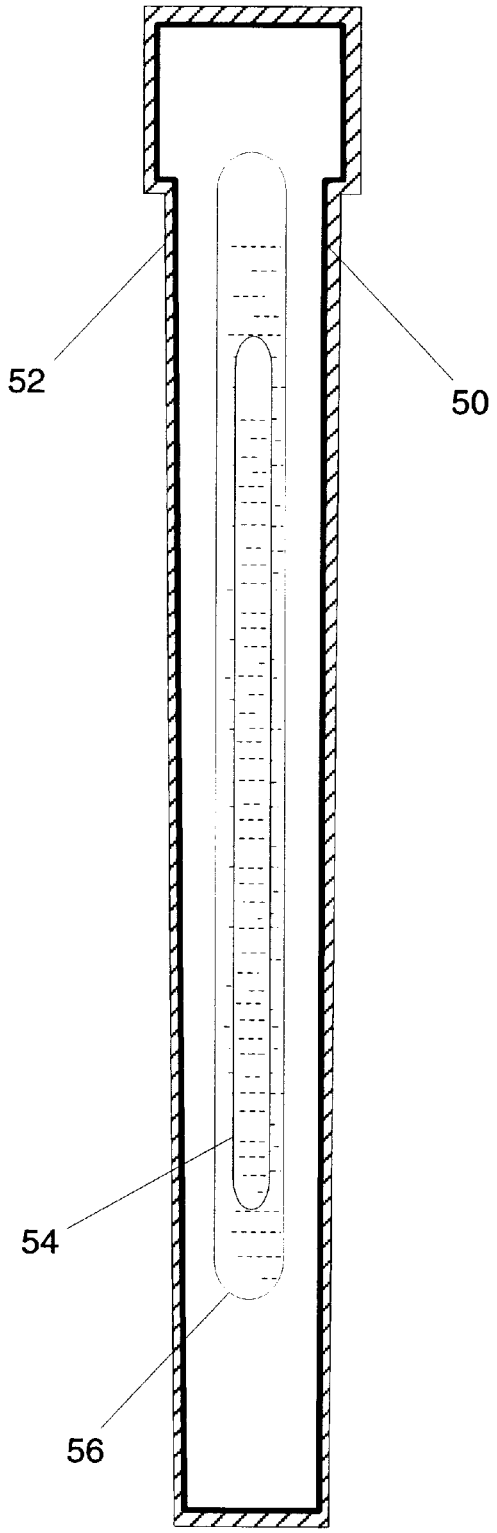
FIG. 4 is a cross sectional side view of a chemiluminescent light stick illustrating optically opaque sheath or coating positioned between the outermost reagent container and the inside of the outermost container.

As illustrated in FIG. 4, an opaque coating 50 may be applied to the inside of the outermost container 52 whereby the coating is dissolved and/or caused to be released from the container wall by action of one or more of the chemicals in the chemiluminescent solution 54 and 56. The coating remains intact and provides effective light shielding action until the device is activated at which time the chemical solution comes in contact with said coating and effectively removes it from the container wall, thereby permitting useful chemiluminescent light to be emitted from the device. The coating or sleeve may be bleached or otherwise chemically altered by action of the chemiluminescent reagents so as to permit the emission of useful chemiluminescent light.

Figure 5:
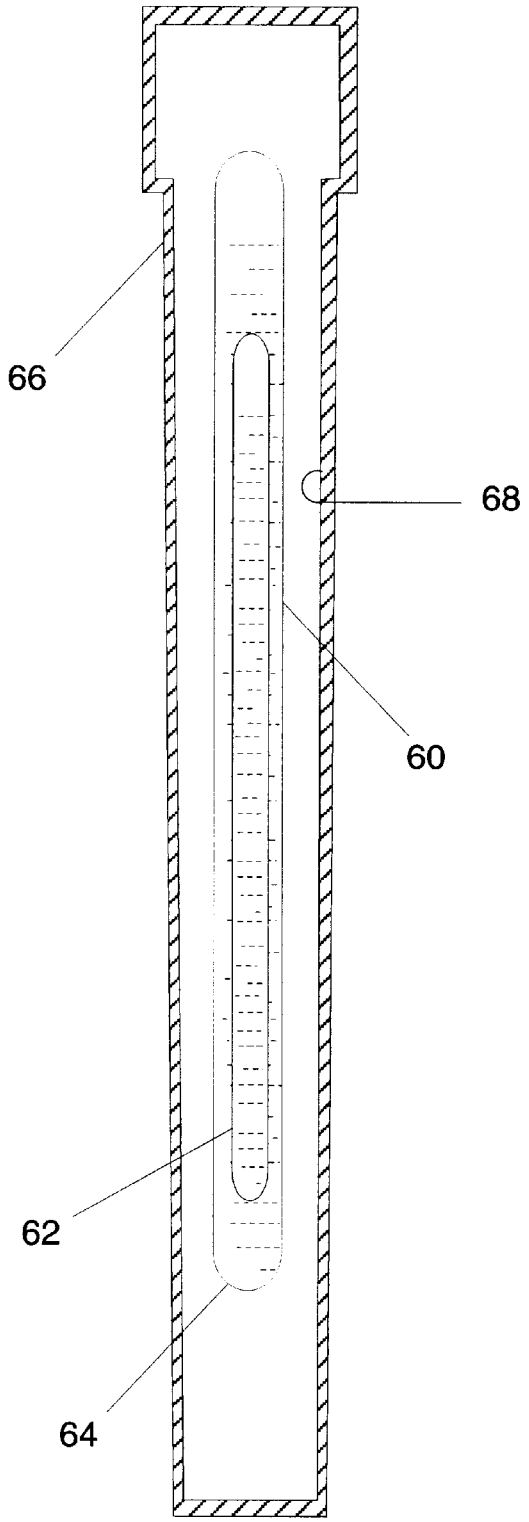
FIG. 5 is a cross sectional side view of a chemiluminescent light stick illustrating an optically opaque thin film coating placed on the outer surface of the oxalate ampoule.

FIG. 5 depicts the use of a non-organic, thin film coating 60. This coating may be applied to the outer surfaces of both ampoules 62 and 64 or if a coaxial system is used, it may be applied only to the outermost ampoule 64. Likewise it may be applied to the inner surface 68 of the outermost container 66. Very thin metal films are particularly well suited as light shields for this application. Because of their atomic structure, metals provide efficient photon trapping mechanisms. Completely opaque metal films may be realized with film thicknesses as thin as 1000 to 2000 angstroms. Chromium and titanium are known to work well in these applications if glass ampoules are to be employed as receptacles for the chemiluminescent reagents. Aluminum films form an effective light shield but typically do not, in and of themselves, adhere well to glass. These metal films may be deposited by use of electron beam or sputtering technologies such as are well known in the thin film industry. Because coatings on the outside of the glass ampoules in a dual ampoule system or on the inside of the outermost container in a dual ampoule system do not contact the chemical reagents until after activation, long term chemical compatibility is not an issue. Alternatively, the metal film may consist of aluminum foil, with or without perforations.

It is conceivable that any of the coatings, sleeves, or other shielding means could be employed in a system whereby said coating is wetted by a first chemiluminescent reagent which does not alter said coating's ability to block light. At time of activation, exposure of the coating to the second chemiluminescent reagent would cause said coating to become optically transparent either by dissolution of the coating, release of the coating from the substrate onto which it is coated or through chemical means whereby the coating is bleached or otherwise chemically altered so as to permit the emission of useful chemiluminescent light.

The instant invention satisfies all necessary requirements for an integral light shield to be used with chemiluminescent systems. These requirements are:

1 The light shield must effectively block ambient light from the chemiluminescent reagents.

2 The light shield must be chemically inert so as not to interfere with the chemiluminescent reaction.

3 The light shield must allow the useful chemiluminescent light to escape from the chemiluminescent device.

4 The light shield must present minimal, if any interference to the activation process.

It is understood that the means of producing integral light shields for chemiluminescent devices includes but is not limited to the specific materials and embodiments described herein and that other embodiments exist to meet the requirements of such a system. It will be apparent to those skilled in the art that various changes may be made without departing from the scope of the invention and the invention is not to be considered limited to what is shown in the drawings and described in the specification.

What is claimed is:

1. A chemiluminescent device comprising: a first sealed frangible ampoule containing a chemiluminescent activator reagent; a second sealed frangible ampoule containing a chemiluminescent oxalate reagent; an internal light shield characterized as an opaque film concealing at least a portion of said first and second ampoule from external light; and a most external transparent sealed container sized to support said ampoules;

whereby said opaque film shields said reagents from external light wherein the breaking of said ampoules causes said film to rupture allowing said reagents to admix and produce chemiluminescent light visible through said container.

2. The chemiluminescent device according to claim 1 including a liquid absorbent material disposed in said container, said absorbent material holding admixed reagents providing an even distribution of chemiluminescent light.

3. The chemiluminescent device according to claim 1 wherein said opaque film is black polyethylene tubing encompassing at least a portion of said ampoules.

4. The chemiluminescent device according to claim 1 wherein said opaque film is black polyvinyl chloride tubing encompassing at least a portion of said ampoules.

5. The chemiluminescent device according to claim 1 wherein said container is constructed from HDPE.

6. The chemiluminescent device according to claim 1 wherein said film is perforated.

7. The chemiluminescent device according to claim 2 wherein said absorbent material is non-woven polyester.

8. The chemiluminescent device according to claim 1 wherein said opaque film is formed into a bag with said ampoules sealed therein.

9. The chemiluminescent device according to claim 3 wherein said opaque film is formed into a bag with said ampoules sealed therein.

10. The chemiluminescent device according to claim 1 wherein said opaque film is a colored paint applied to the outer surface of said ampoules.

11. The chemiluminescent device according to claim 1 wherein said opaque film is an organic colored paint applied to the inner surface of said container.

12. The chemiluminescent device according to claim 1 wherein said opaque film is a metal film having a film thickness as thin as 1000 to 2000 angstroms applied to the outer surface of said ampoules.

13. The chemiluminescent device according to claim 1 wherein said opaque film is a metal film having a film thickness as thin as 1000 to 2000 angstroms applied to the inner surface of said container.

14. The chemiluminescent device according to claim 1 wherein said opaque film is aluminum foil.

15. A chemiluminescent device comprising: a first sealed frangible ampoule containing a chemiluminescent activator reagent; a second sealed frangible ampoule containing a chemiluminescent oxalate reagent; an internal light shield characterized as an optically opaque film concealing at least a portion of said first and second ampoule from external light; a non-woven polyester liquid absorbent material; and a most external transparent sealable container sized to support said ampoule;

whereby said opaque film shields said reagents from external light wherein the breaking of said ampoules causes said film to rupture allowing said reagents to admix and produce chemiluminescent light visible through said container.

16. The chemiluminescent device according to claim 15 wherein said film is polyethylene having sealable ends.

17. The chemiluminescent device according to claim 15 wherein said film is polyvinyl chloride having sealable ends.

18. A chemiluminescent device comprising: a first sealed frangible ampoule containing a chemiluminescent activator reagent; a second sealed frangible ampoule containing a chemiluminescent oxalate reagent; an internal light shield characterized as an opaque coating concealing at least a portion of said first and second ampoule from external light; a non-woven polyester liquid absorbent material; and a most external plastic transparent sealable container sized to support said ampoule;

whereby said opaque coating shields said reagents from external light wherein the breaking of said ampoules causes said coating to rupture allowing said reagents to admix and produce chemiluminescent light visible through said container.

19. The chemiluminescent device according to claim 18 wherein said coating is applied to the outer surface of said ampoules.

20. The chemiluminescent device according to claim 18 wherein said coating is organic and applied to an inner surface of said container.

21. The chemiluminescent device according to claim 18 wherein said coating is colored paint.

22. A chemiluminescent device comprising: a first sealed frangible ampoule containing a chemiluminescent activator reagent; a second sealed frangible ampoule containing a chemiluminescent oxalate reagent; an internal light shield characterized as a metal coating shielding at least a portion of said first and second ampoule from external light; a non-woven polyester liquid absorbent material; and a most external plastic transparent sealable container sized to support said ampoule;

whereby said metal coating shields said reagents from external light wherein the breaking of said ampoules causes said coating to rupture allowing said reagents to admix and produce chemiluminescent light visible through said container.

23. The chemiluminescent device according to claim 22 wherein said metal coating is applied to the outer surface of said ampoules.

24. The chemiluminescent device according to claim 22 wherein said metal coating is applied to an inner surface of said container.

25. The chemiluminescent device according to claim 22 wherein said metal coating is from the group of metals capable of being deposited by use of electron beam or sputtering including chromium, titanium, and aluminum metals.

26. The chemiluminescent device according to claim 22 wherein said metal coating is aluminum foil.

* * * * *